US011217143B2

(12) United States Patent
Lin et al.

(10) Patent No.: US 11,217,143 B2
(45) Date of Patent: Jan. 4, 2022

(54) DISPLAY DEVICE

(71) Applicant: AU Optronics Corporation, Hsin-Chu (TW)

(72) Inventors: Shih-Wei Lin, Hsin-Chu (TW); Chen-Yi Wu, Hsin-Chu (TW)

(73) Assignee: AU OPTRONICS CORPORATION, Hsin-Chu (TW)

( * ) Notice: Subject to any disclaimer, the term of this patent is extended or adjusted under 35 U.S.C. 154(b) by 0 days.

(21) Appl. No.: 17/080,882

(22) Filed: Oct. 27, 2020

(65) Prior Publication Data

US 2021/0295755 A1 Sep. 23, 2021

(30) Foreign Application Priority Data

Mar. 17, 2020 (TW) ..... 109108830

(51) Int. Cl.
*G09G 3/20* (2006.01)

(52) U.S. Cl.
CPC ..... *G09G 3/20* (2013.01); *G09G 2300/0408* (2013.01); *G09G 2310/0232* (2013.01); *G09G 2310/0275* (2013.01)

(58) Field of Classification Search
CPC .. G09G 3/3648; G09G 3/3659; G09G 3/3266; G09G 2300/0408
See application file for complete search history.

(56) References Cited

U.S. PATENT DOCUMENTS

2010/0171687 A1 7/2010 Chiang et al.
2014/0043306 A1* 2/2014 Min ..... G09G 3/3677 345/204
2018/0012544 A1* 1/2018 Park ..... G09G 3/3233
2019/0252411 A1 8/2019 Lee et al.

* cited by examiner

*Primary Examiner* — Gerald Johnson
(74) *Attorney, Agent, or Firm* — WPAT, PC

(57) ABSTRACT

A display device includes a substrate, gate lines, a driving circuit, and auxiliary gate lines. The substrate has a display area. The gate lines are disposed on the display area, and are in parallel with a first edge of the display area. The gate lines include a first gate line which is farthest from the first edge. The driving circuit is disposed adjacent to the first edge. The auxiliary gate lines substantially perpendicular to the gate lines are connected to the gate lines, and are in parallel with a second edge of the display area. The auxiliary gate lines include a first auxiliary gate line and at least one auxiliary gate line. The first auxiliary gate line is configured to connect the first gate line to the driving circuit. The at least one auxiliary gate line is disposed between the second edge and the first auxiliary gate line.

10 Claims, 5 Drawing Sheets

DISPLAY DEVICE

RELATED APPLICATION

The present application claims priority to Taiwan Application Serial Number 109108830, filed Mar. 17, 2020, which is incorporated herein by reference in its entirety.

BACKGROUND

Technical Field

The present disclosure relates to a display device. More particularly, the present disclosure relates to narrow border display device.

Description of Related Art

As advance of display device technology, users are seeking for advanced designs related to a panel border of a display device. On a modern display device with a narrow panel border, it often utilizes layout with additional gate lines connected between original gate lines and driving circuit disposed parallel to the original gate lines, and the connection manner is sometimes called V-shaped interconnection. Although such layout can narrow down borders of left and right side of the display device or panel, the additional gate lines increase a resistance-capacitance (RC) load. Consequently, it is difficult to apply this kind of layouts having increased RC load onto a panel with a large size, a high resolution, and/or a high refresh rate.

SUMMARY

To solve the problem mentioned above, an aspect of the present disclosure provides a display device, which includes a substrate, a plurality of gate lines, a driving circuit, a plurality of auxiliary gate lines. The substrate includes a display area. The gate lines are disposed in the display area. The gate lines are substantially parallel with a first edge of the display area. The gate lines include a first gate line farthest from the first edge. The driving circuit is disposed adjacent to the first edge. The auxiliary gate lines are disposed in the display area. The auxiliary gate lines are connected to the gate lines and substantially perpendicular relative to the data lines, and are in parallel with a second edge of the display area. The auxiliary gate lines include a first auxiliary gate line and at least one auxiliary gate line. The first auxiliary gate line is configured to connect the first gate line to the driving circuit. The at least one auxiliary gate line is disposed between the first auxiliary gate line and the second edge.

Another aspect of the present disclosure provides a display device, which includes a substrate, a plurality of data lines, a first driving circuit and a plurality of auxiliary data lines. The substrate includes a display area. The display area includes a first area and a second area. The first area is adjacent to a first side edge of the display area. The second area is adjacent to a second side edge of the display area. The first side edge and the second side edge are located at opposite sides relative to the display area. The data lines are disposed in the first area and the second area. The data lines include a first data line farthest from the first side edge in the first area. The first driving circuit is disposed adjacent to the first side edge of the display area. The auxiliary data lines are disposed in the first area and the second area. The auxiliary data lines are connected to the data lines and substantially perpendicular relative to the data lines, and are substantially parallel with a top edge of the display area. The auxiliary data lines in the first area include a first auxiliary data line, at least one auxiliary data line. The first auxiliary data line is configured to connect the first data line to the first driving circuit. The at least one auxiliary data line is disposed between the top edge and the first auxiliary data line.

BRIEF DESCRIPTION OF THE DRAWINGS

The present disclosure can be more fully understood by reading the following detailed description of the embodiment, with reference made to the accompanying drawings as follows.

DETAILED DESCRIPTION

Figure 1:
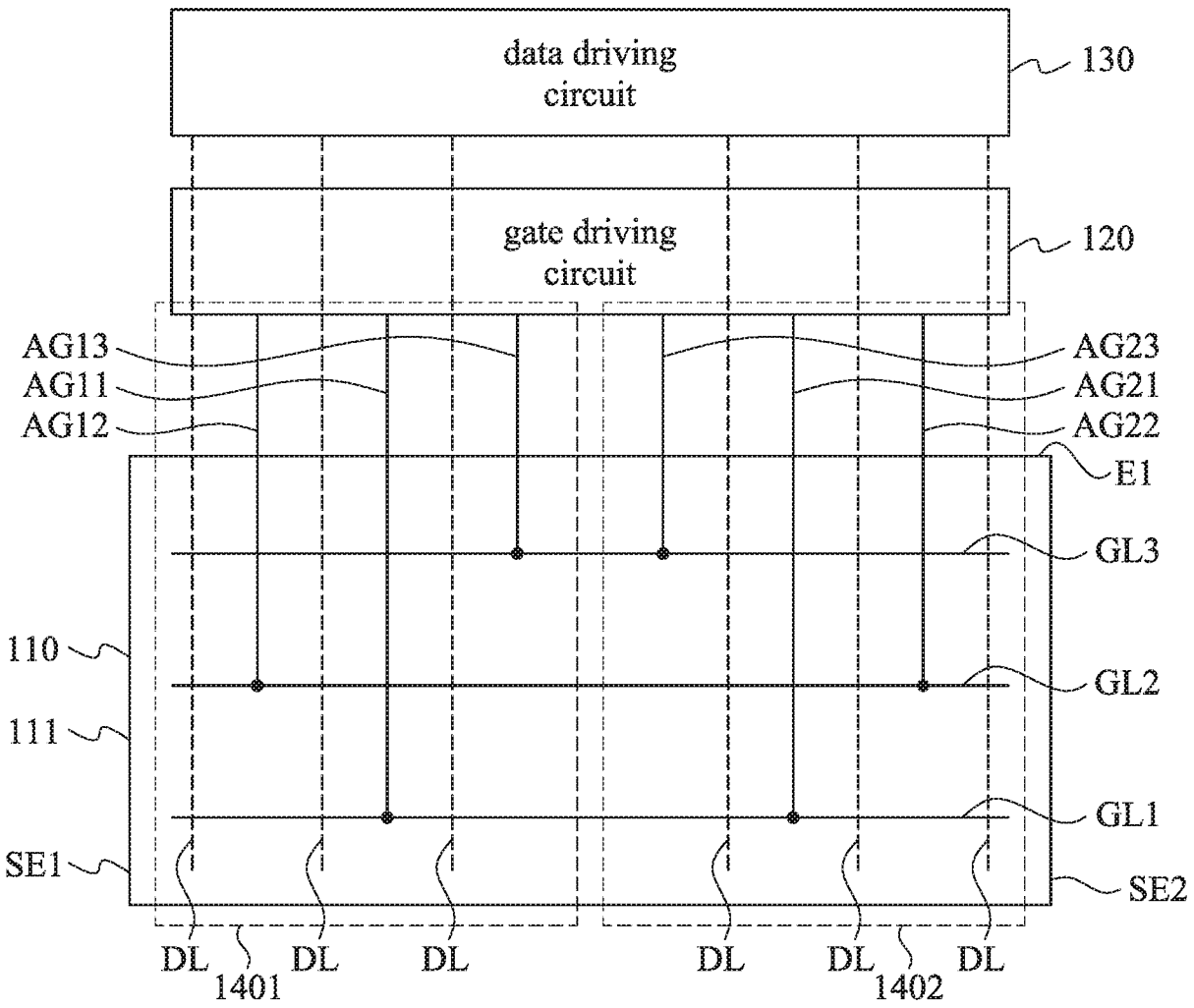
FIG. 1 is a schematic diagram illustrating a display device, in accordance with an embodiment of the present disclosure.

Reference will now be made in detail to the present embodiments of the disclosure, examples of which are illustrated in the accompanying drawings. Wherever possible, the same reference numbers are used in the drawings and the description to refer to the same or like parts.

It will be understood that, although the terms first, second, third etc. may be used herein to describe various elements, components and/or sections, these elements, components and/or sections should not be limited by these terms. These terms are only used to distinguish one element, component or section from another element, component or section. Thus, a first element, component or section discussed below could be termed a second element, component or section without departing from the teachings of the present disclosure.

The terms herein are used for describing particular embodiments and are not intended to be limited thereto. Single forms such as "a", "this", "the", as used herein also include the plurality form.

In the description herein and throughout the claims that follow, the terms "coupled" or "connected" in this document may be used to indicate that two or more elements physically or electrically contact with each other, directly or indirectly. They may also be used to indicate that two or more elements cooperate or interact with each other.

In the description herein and throughout the claims that follow, the terms "comprise" or "comprising," "include" or "including," "have" or "having," "contain" or "containing" and the like used herein are to be understood to be open-ended, i.e., to mean including but not limited to.

In the description herein and throughout the claims that follow, the phrase "and/or" includes any and all combinations of one or more of the associated listed claims.

In the description herein and throughout the claims that follow, unless otherwise defined, all terms have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Reference is made to FIG. 1. FIG. 1 is a schematic diagram illustrating a display device 100, in accordance with an embodiment of the present disclosure. As shown in FIG. 1, the display 100 includes a substrate 110, a gate driving circuit 120 and a data driving circuit 130.

The substrate 110 includes a display area 111, which includes a top edge E1 and a first side edge SE1 perpendicular to the top edge E1. The gate driving circuit 120 and the data driving circuit 130 are disposed on the same side relative to the display area 111, and the gate driving circuit 120 and the data driving circuit 130 are adjacent to the top edge E1 of the display area 111.

In the usual configuration of the display device, the gate driving circuit and the data driving circuit are generally disposed on different sides of the display area. For example, the data diving circuit can be disposed in the top and bottom sides of the display area, and data diving circuit can transmit data to the display area through data lines extending vertically; the gate driving circuit can be disposed in the left and right sides of the display area, and can transmit data to the display area through the data lines extending horizontally, so as to control pixels in the display area. In the above mentioned configuration, at least one of top and bottom sides and at least one of left and right sides of the display area requires to reserve certain width to accommodate the gate driving circuit, the data driving circuit and related circuit connection points. Because of the aforementioned configuration, it is hard to narrow down the border widths on four sides of the display device. In the trend of the current mobile device, it is desired to achieve the display panel with a narrow border and a high screen-to-body ratio. The aforementioned configuration make it difficult to further narrow down the border and to further improve the screen-to-body ratio.

As the embodiment shown in FIG. 1, the gate driving circuit 120 and the data driving circuit 130 of the display device 100 are disposed on the same side relative to the display area 111 (such as the top edge E1 of the display area 111). Thus, the left and right sides relative to the display area 111 no need to reserve the additional space to accommodate the date driving circuit. As a result, the border width of the display device 100 can be decreased. The detail configuration manner will be described in detail in following paragraphs.

In some embodiments, the display area 111 includes multiple data lines DL and multiple gate lines GL1~GL3. The data lines DL and the gate lines GL1~GL3 are respectively connected to multiple display pixels (not shown) arranged in a matrix manner in the display area 111. The data driving circuit 130 is configured to generate data voltage to the data lines DL, and the data driving circuit 130 provides the data voltage to each of display pixels of the display area 111 through the data lines DL. The gate driving circuit 120 is configured to generate gate voltages to the gate lines GL1~GL3, and the gate driving circuit 120 controls pixel switches of each of display pixels through the gate voltage of gate lines GL1~GL3.

As shown in FIG. 1, the data lines DL are completely or substantially parallel to the first side edge SE1 of the display area 111. The gate lines GL1~GL3 are completely or substantially parallel to the top edge E1 of the display area 111.

In some embodiments, in order to accommodate the gate driving circuit 120 and the data driving circuit 130 on the same side relative to the display area 111, there are auxiliary gate lines AG11~AG13 and AG21~AG23 disposed in the display area 111 for connecting the horizontal gate lines GL1~GL3 over vertical gaps to the gate driving circuit 120, which is disposed on a top side relative to the display area 111. The gate lines GL1~GL3 are respectively connected to the corresponding vertical auxiliary gate lines AG11~AG13 and AG21~AG23 contained in the display area 111, such that the gate lines GL1~GL3 can be able to connect to the gate driving circuit 120 through the auxiliary gate lines AG11~AG13 and AG21~AG23. The auxiliary gate lines AG11~AG13 and AG21~AG23 are completely or substantially parallel to the first side edge SE1 of the display area 111.

In other words, in the embodiment shown in FIG. 1, the auxiliary gate lines AG11~AG13 and AG21~AG23 extending vertically are connected between the gate driving circuit 120 and the gate lines GL1~GL3 extending horizontally. The auxiliary gate lines AG11~AG13 and AG21~AG23 are configured to transmit gate signals generated by the gate driving circuit 120 disposed on the top side of the display area 111 along the vertical direction to the different gate lines GL1~GL3. In this way, the display device 100 can be implement with disposing the gate driving circuit 120 and the data driving circuit 130 on the same side of the display area, and can also remain the normal function for driving gate lines and driving data lines at the same time.

In some embodiments, the auxiliary gate lines AG11~AG13 and the auxiliary gate lines AG21~AG23 are disposed in mirror symmetry manner. For better understanding, reference is made to a first auxiliary gate line group 1401 of the left half of the display area 111 as shown in FIG. 1, the first auxiliary gate line group 1401 includes the auxiliary gate lines AG11~AG13. The auxiliary gate line AG11 is connected to the gate line GL1 farthest from the top edge E1, and the auxiliary gate line AG12 connected to the gate line GL2 is between the auxiliary gate line AG11 and the first side edge SE1. In other words, among the auxiliary gate lines AG, the auxiliary gate line AG11 is not the closest one to the edge of the display area 111. There is at least one of the auxiliary gate lines AG located between the auxiliary gate line AG11 and the first side edge SE1.

Similarly, reference is made to a second auxiliary gate line group 1402 of the right half of the display area 111 as shown in FIG. 1, the second auxiliary gate line group 1402 includes auxiliary gate lines AG21~AG23. The auxiliary gate line AG21 is connected to the gate line GL1 farthest from the top edge E1, and the auxiliary gate line AG22 connected to the gate line GL2 is disposed between to the auxiliary gate line AG21 and another side edge SE2 opposite to the first side edge SE1. In the other words, the auxiliary gate line AG21 is not the one closest to the side edge SE2 of the display area 111 of the auxiliary gate line AG. At least one auxiliary gate line AG is between the auxiliary gate line AG21 and the side edge SE2.

In some examples, if the auxiliary gate line with the longest length (such as the auxiliary gate line AG11 shown in FIG. 1) connected to the farthest gate line (such as the gate line GL1 shown in FIG. 1) away from the gate driving circuit 120 is disposed at the outermost of the display area (such as at the position closest to the first side edge SE1), a trace distance will be relatively longer from gate driving circuit 120 to the pixel located at center and the bottom of the display area 111 through the aforementioned wirings (e.g., AG11 and GL1). In this case, a resistance-capacitance (RC) loading on the aforementioned wirings (e.g., AG11 and GL1) is relatively large.

Compared to the examples to dispose the longest auxiliary gate line (e.g., the auxiliary gate line AG11) at the outermost position of the display area, the auxiliary gate line AG11 according to the aforementioned embodiments shown in FIG. 1 is not disposed at the outermost position of the display area 111, and it can reduce a total distance from the driving circuit 120 through the auxiliary gate line AG11 and the corresponding gate line to the farthest target pixel, such that a RC loading over the auxiliary gate line AG11 can be reduced and a gate fall time on the target pixel can also be reduced.

Figure 2:
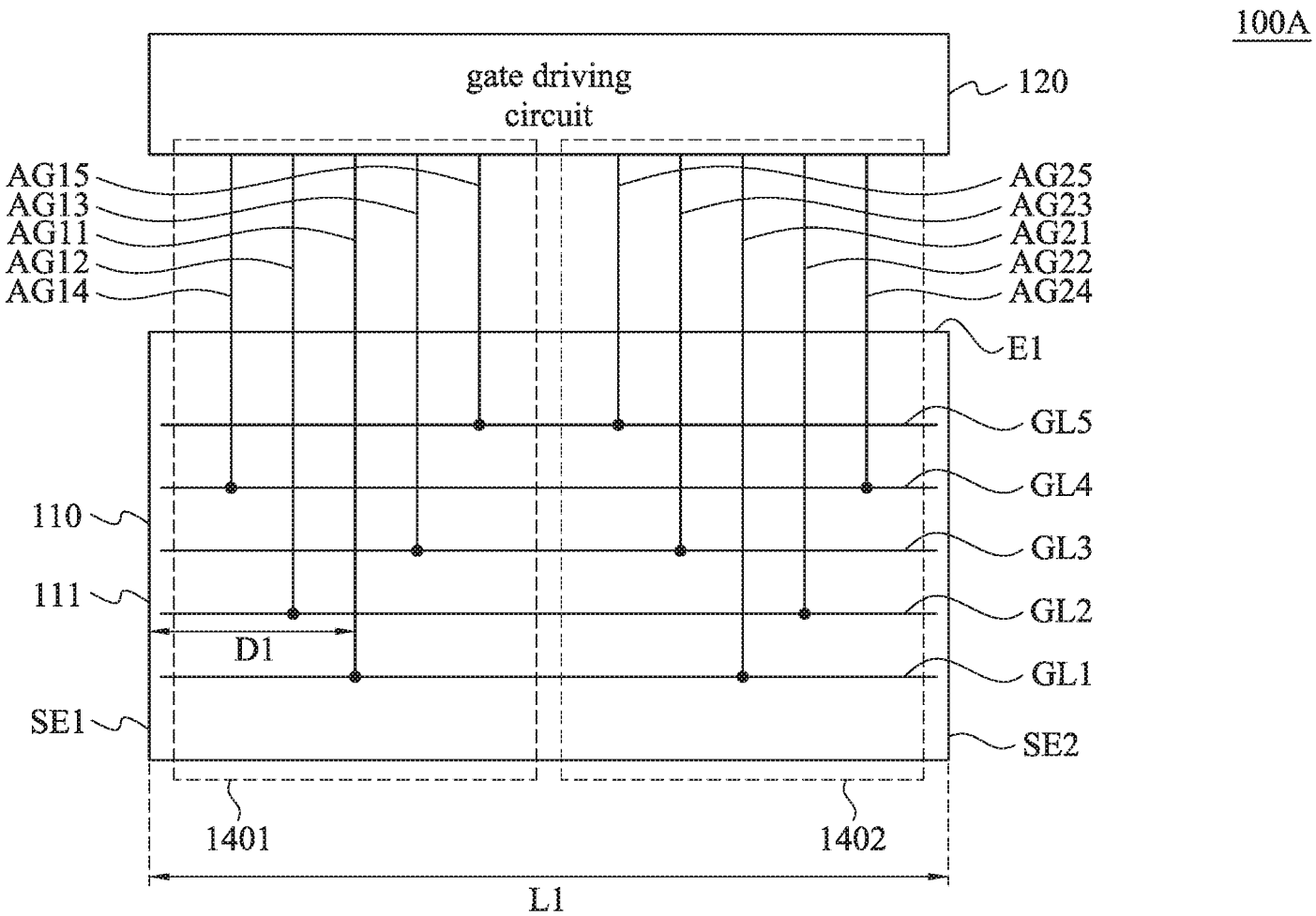
FIG. 2 is a schematic diagram illustrating a part of the display device in FIG. 1, in accordance with an embodiment of the present disclosure.

Reference is made to FIG. 2. FIG. 2 is a schematic diagram illustrating a part of the display device in FIG. 1, in accordance with an embodiment of the present disclosure. To make it easier to understand the diagram, the data driving circuit and the data line shown in FIG. 1 are omitted in the display device 100A shown in the FIG. 2. Compared to FIG. 1, FIG. 2 illustrates further details about the gate driving circuit 120 and the corresponding wirings.

As shown in FIG. 2, the display device 100A includes a substrate 110 and gate driving circuit 120. The substrate 110 includes display area 111. The display area 111 includes a top edge E1, a first side edge SE1 and a second side edge SE2. The gate driving circuit 120 is disposed in one side adjacent to the top edge E1.

In some embodiments, the gate lines GL1~GL5 connected to the gate driving circuit 120 are located in the display area 111. The gate lines GL1~GL5 are completely or substantially parallel to the top edge E1 of the display area 111. A first auxiliary gate line group 1401 and a second auxiliary gate line group 1402 are located in the display area 111.

In some embodiments, the first auxiliary gate line group 1401 includes auxiliary gate lines AG11~AG15. The auxiliary gate line AG11 is connected to the gate line GL1 farthest from the top edge E1. The auxiliary gate line AG12 shifts a distance X from the auxiliary gate line AG11 toward the first side edge SE1, and the auxiliary gate line AG12 is connected to the gate line GL2 second farthest from the top edge E1. The auxiliary gate line AG13 shifts a distance X from the auxiliary gate line AG11 toward the second side edge SE2, which is on opposite side of the first side edge SE1, and the auxiliary gate line AG13 is connected to the gate line GL3. And so on, each of the auxiliary gate lines AG are respectively connected to one of the gate lines GL in an alternately manner, "left, right, left, right", such that the gate lines GL (extending horizontally) can be connected through the auxiliary gate lines AG to the gate driving circuit 120 adjacent to the top edge E1.

In some embodiments, the second auxiliary gate line group 1402 includes the auxiliary gate lines AG21~AG25. The auxiliary gate line AG21 is connected to the gate line GL1 farthest from the top edge E1. The auxiliary gate line AG22 shifts a distance X from the auxiliary gate line AG21 toward the second side edge SE2, which is opposite to the first side edge SE1, and the auxiliary gate line AG22 is connected to the gate line GL2 second farthest from the top edge E1. The auxiliary gate line AG23 shifts a distance X from the auxiliary gate line AG21 toward the first side edge SE1, and the auxiliary gate line AG23 is connected to the gate line GL3. And so on, the auxiliary gate lines AG is respectively connected to one of the gate lines GL in an alternately manner, "right, left, right, left", such that the gate lines GL (extending horizontally) can be connected through the auxiliary gate lines AG to the gate driving circuit 120 adjacent to the top edge E1.

According to above embodiments, each of the gate lines GL1~GL5 is utilized one of the auxiliary gate lines AG in the first auxiliary gate line group 1401 and one of the auxiliary gate lines AG in the second auxiliary gate line group 1402 to connect to the gate driving circuit 120. Furthermore, the auxiliary gate lines AG in the first auxiliary gate line group 1401 and the auxiliary gate lines AG in the second auxiliary gate line group 1402 are arranged in mirror symmetry.

In some embodiments, since one gate line GL is connected to two auxiliary gate lines AG, a distance D1 between the auxiliary gate line AG11 and the first side edge SE1 is a quarter of the length L1 of the display area 111. That is, the distance D1=L1/4.

Figure 3:
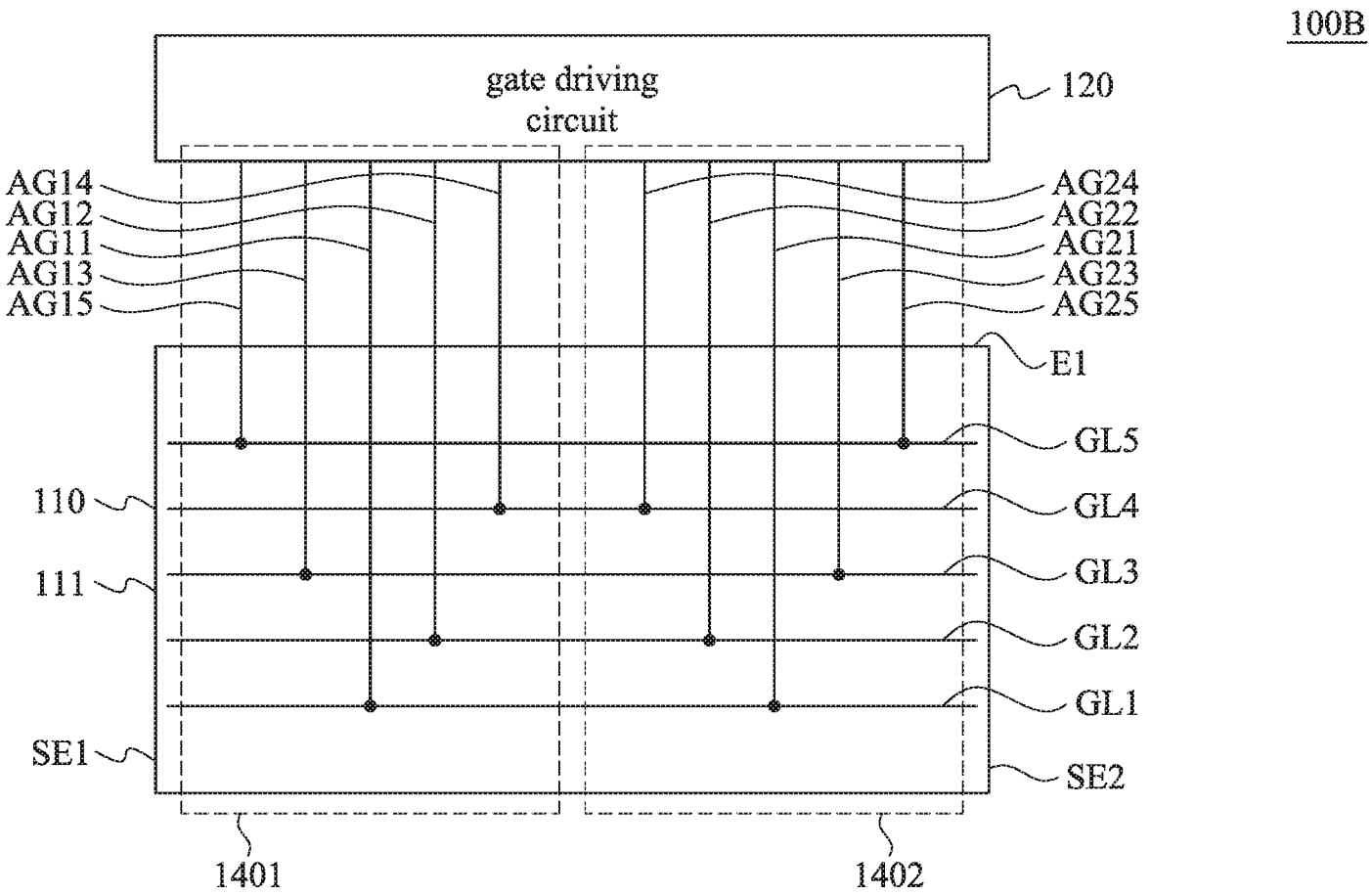
FIG. 3 is a schematic diagram illustrating a part of the display device in FIG. 1, in accordance with another embodiment of the present disclosure.

Reference is made to FIG. 3. FIG. 3 is a schematic diagram illustrating a part of the display device in FIG. 1, in accordance with another embodiment of the present disclosure. The different between FIG. 3 and FIG. 2 is that the auxiliary gate lines AG in the first auxiliary gate line group 1401 and the second auxiliary gate line group 1402 of the embodiments shown in FIG. 3 and FIG. 2 are arranged in different manners. Although the auxiliary gate lines AG in first auxiliary gate line group 1401 and the second auxiliary gate line group 1402 are arranged in mirror symmetry in the display device 100B, the auxiliary gate lines AG in the first auxiliary gate line group 1401 are arranged in an alternate manner, "right, left, right, left", and the auxiliary gate lines AG in the second auxiliary gate line group 1402 are arranged in an alternate manner, "left, right, left, right". In other words, different from the arrangement of auxiliary gate lines in the first auxiliary gate line group 1401 of the display device 100A, which are arranged in a sequence of AG14, AG12, AG11, AG13 and AG15 from the first side edge SE1 toward center of the display area 111, the auxiliary gate lines in the first auxiliary gate line group 1401 of the display device 100B are arranged in a sequence of AG15, AG13, AG11, AG12 and AG14 from the first side edge SE1 toward center of the display area 111. The arrangement of the auxiliary gate lines AG in the second auxiliary gate line group 1402 of the display device 100B compared to the second auxiliary gate line group 1402 in the display device 100A is also changed. For the brief description, not to be repeated here.

Compare to the configuration manner that the auxiliary gate line AG11 connected to the gate line GL1 farthest from the gate driving circuit 120 is disposed at the outermost of the display area 111 (adjacent to the first side edge SE1), the aforementioned embodiments can effectively decrease the RC load of the auxiliary gate line AG11, and decrease data fall time by fifteen to twenty five percent.

Figure 4:
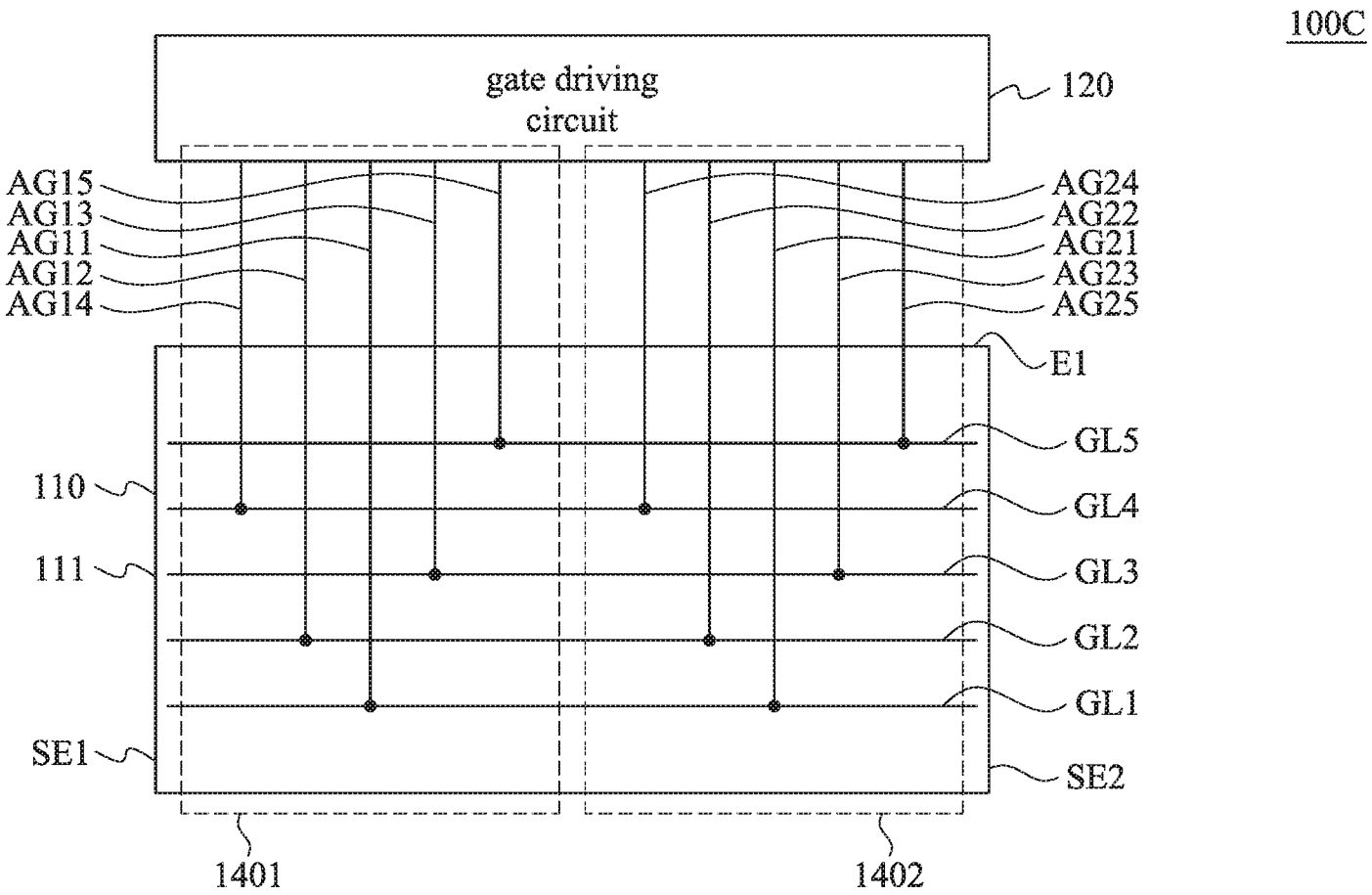
FIG. 4 is a schematic diagram illustrating a part of the display device in FIG. 1, in accordance with another embodiment of the present disclosure.

Reference is made to FIG. 4. FIG. 4 is a schematic diagram illustrating a part of the display device in FIG. 1, in accordance with another embodiment of the present disclosure. The different between FIG. 4 and FIG. 2 is that partial of the auxiliary gate lines AG of the embodiments shown in FIG. 4 and FIG. 2 are arranged in different configurations, and the auxiliary gate lines AG in the first auxiliary gate line group 1401 and the second auxiliary gate line group 1402 of the embodiments shown in FIG. 4 and FIG. 2 are arranged in different configurations of symmetry. As shown in FIG. 4, the first auxiliary gate line group 1401 of the display device 100C is similar to the first auxiliary gate line group 1401 of the display device 100A shown in FIG. 2. The auxiliary gate lines AG21~AG25 in the second auxiliary gate line group 1402 of the display device 100C is similar to the auxiliary gate lines AG11~AG15 in the first auxiliary gate line group 1401 of the display device 100A shown in FIG. 2 instead of the second auxiliary gate line group 1402 of the display device 100A. In other words, since the auxiliary gate lines AG11~AG15 in the first auxiliary gate line group 1401 are arranged in an alternately manner, "left, right, left, right", the auxiliary gate lines AG21~AG25 of the second auxiliary gate line group 1402 are also arranged in the alternately manner, "left, right, left, right", such that the first auxiliary gate line group 1401 and the second auxiliary gate line group 1402 in the display device 100C are arranged in translation symmetry.

Similarly, during the auxiliary gate lines AG11~AG15 in the first auxiliary gate line group 1401 are arranged in an alternately manner, "right, left, right, left" (not shown), the auxiliary gate lines AG21~AG25 in the second auxiliary gate line group 1402 are arranged in the alternately manner, "right, left, right, left", such that the auxiliary gate lines AG11~AG15 in the first auxiliary gate line group 1401 and the auxiliary gate lines AG21~AG25 in the second auxiliary gate line group 1402 are arranged in translation symmetry in the display device 100C.

In practically, compared to the mirror symmetry configuration of the first auxiliary gate line group 1401 and the second auxiliary gate line group 1402, the configuration utilizing the aforesaid translation symmetry manner can be performed in spliced way instead of using different photomasks during an exposure process. Therefore, the configuration utilizing the aforesaid translation symmetry manner can be more advantage for fabrication cost and efficiency consideration.

To be noted that, in order to simplify the description, the aforementioned embodiments and the associated diagrams are only take a part of elements as examples to describe the connection relationship thereof, and two auxiliary gate lines AG connected to one gate line GL are taken as examples in all of the aforementioned embodiments. The aforementioned embodiments can be applied to combination of any number of the gate lines GL and data lines DL, and any number of the auxiliary gate lines AG can be connected to gate lines GL, the present disclosure should not be limited thereto. Since each of the gate lines GL is driven by these n sets of auxiliary gate lines AG (that is, these n sets of auxiliary gate lines AG are connected to the same gate line GL), a distance between one of these n sets of auxiliary gate lines AG connected to the gate line G1 farthest from the top edge E1 and closest to the first side edge SE1 and the first side edge SE1 is ½n times of the length L1 of the display area, and distances between adjacent auxiliary gate lines AG are all 1/n times of the length L1.

In the above mentioned embodiments, the gate driving circuit 120 is disposed on the top side relative to the display area 111, and the data driving circuit 130 is disposed on the same side (i.e., the top side) relative to the display area 111. To be noted that, the present disclosure should not be limited to the aforementioned configuration manner. In practice, the data driving circuit can be disposed at a bottom side, a left side, a right side, or both of right and left sides relative to the display area.

Figure 5:
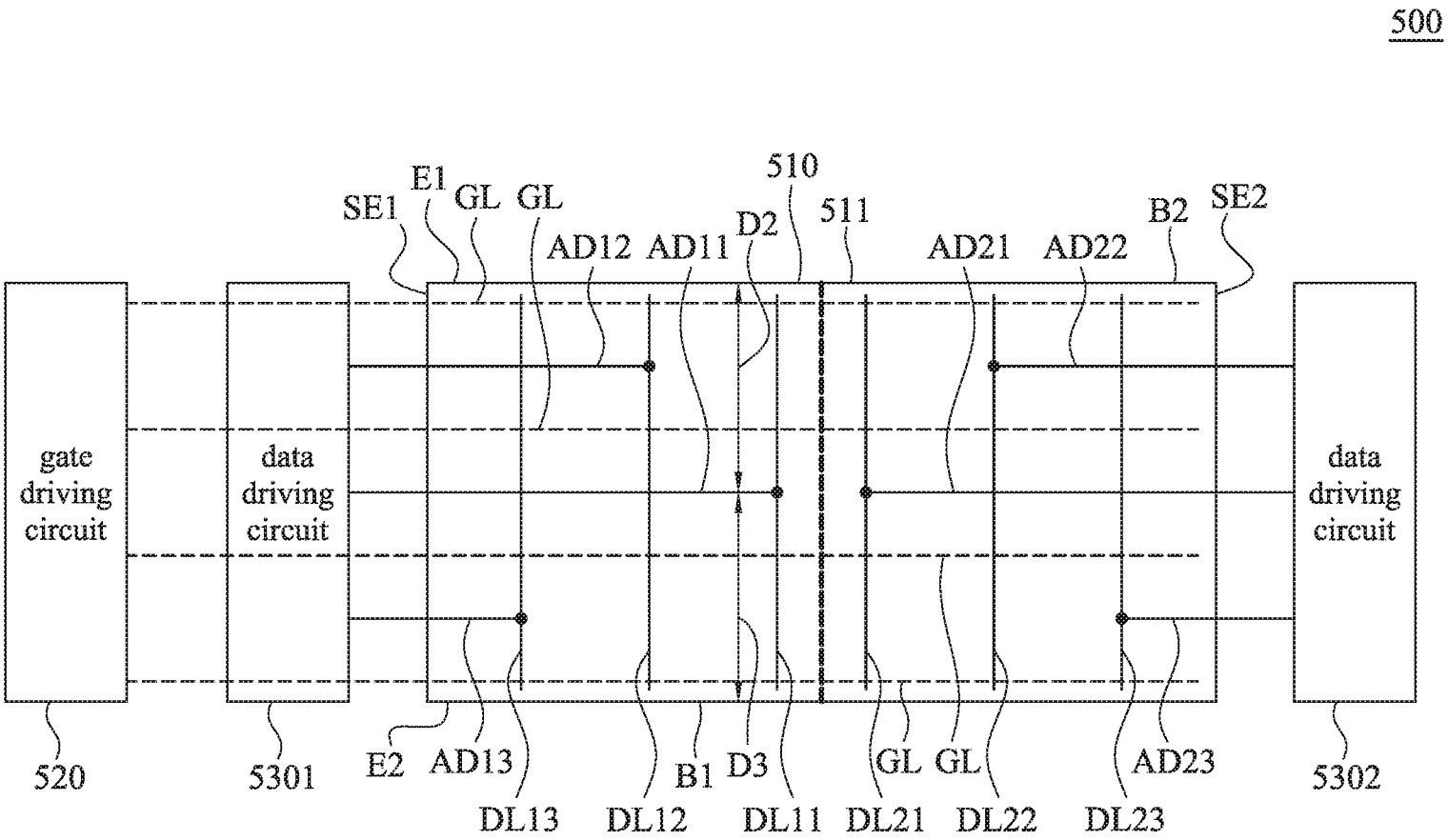
FIG. 5 is a schematic diagram illustrating a display device, in accordance with another embodiment of the present disclosure.

Reference is made to FIG. 5. FIG. 5 is a schematic diagram illustrating a display device 500, in accordance with another embodiment of the present disclosure. As shown in FIG. 5, a display device 500 includes substrate 510, a gate driving circuit 520, data driving circuit 5301 and a data driving circuit 5302.

The substrate 510 includes the display area 511. The display area 511 includes a top edge E1, a bottom edge E2, a first side edge SE1 and a second side edge SE2. The top edge E1 is substantially parallel and corresponds to the bottom side E2. The first side edge SE1 and the second side edge SE2 are substantially perpendicular to the top edge E1. And, the first side edge SE1 and the second side edge SE2 are opposite to each other. The gate driving circuit 520 and the data driving circuit 5301 are disposed on the same side of the display area 111, and are adjacent to the first side edge SE1 relative to the display area 111. The data driving circuit 5302 is disposed on the second side edge SE2 adjacent to the display area 111.

In some embodiments, the display area 111 includes multiple gate lines GL connected to the gate driving circuit 520, and the gate lines GL is completely or substantially parallel to the top edge E1 of the display area 111.

In some embodiments, the display area 111 includes a first area B1 and a second area B2. The first area B1 includes data lines DL11~DL13 and auxiliary data lines AD11~AD13. The auxiliary data lines AD11~AD13 are configured to connect the data lines DL11~DL13 to the data driving circuit 5301 located parallel to the data lines DL11~DL13. The second area B2 includes data lines DL21~DL23 and auxiliary data lines AD21~AD23. The auxiliary data lines AD21~AD23 are configured to connect the data lines DL21~DL23 to the data driving circuit 5301 located parallel to the data lines DL21~DL23. The data lines DL11~DL13 and DL21~DL23 are completely or substantially parallel to the top edge E1 relatively to the display area 111. The auxiliary data lines DL11~DL13 and DL21~DL23 are completely or substantially perpendicular to the top edge E1 relatively to the display area 111.

In some embodiments, the auxiliary data lines AD11~AD13 and auxiliary data lines AD21~AD23 are arranged in mirror symmetry manner. For better understanding, reference is prior made to the first area B1 of the left side of the display area 511 shown in FIG. 5. The auxiliary data line AD11 is connected to the data line DL11 farthest from the first side edge SE1 in the first area B1. The auxiliary data line AD12 is connected to the data line DL12 second farthest from the first side edge SE1. And so on, each of the auxiliary data lines is respectively connected to one of the data lines DL in an alternately manner, "up, down, up, down". In other words, there is at least one auxiliary data line AD disposed on each one of both sides relative to the auxiliary data line AD11.

Similarly, reference is made to the second area B2 of the right side of the display area 511 shown in FIG. 5. The auxiliary data line AD21 is connected to the data line DL21 farthest from the second side edge SE2 in the second area B2, the auxiliary data line AD22 is connected to the data line DL22 second farthest from the second side edge SE2. And so on, each of the auxiliary data lines AD is respectively connected to one of the data lines DL in an alternately manner, "up, down, up, down". In other words, there is at least one auxiliary data line AD disposed on each one of both sides relative to the auxiliary data line AD21.

In some embodiments, a distance D2 between the top edge E1 and both of the auxiliary data line AD11 and the auxiliary data lines AD12 is equal to a distance D3 between the auxiliary data line AD11 and the bottom edge E2.

In some embodiments, the auxiliary data line AD11 can be considered as a center among the auxiliary data lines AD11~AD13 and the auxiliary data line AD21 can be considered as a center among the auxiliary data lines AD21~AD23, such that the remaining auxiliary data lines AD can be arranged in an alternately manner, "down, up, down, up", for brief description, no more repeated here.

In some embodiments, a data fall time on the display device with the configuration manner associated to the description of FIG. 5 can be decreased by fifteen percent, and the configuration manner associated to the description of FIG. 5 is especially suitable for the display panel in a stripe shape.

In the above mentioned embodiments, the data driving circuit 5301 and the data driving circuit 5302 are respectively disposed on both sides relatively to the display area 511, the gate driving circuit 520 is disposed on one of the side edges relatively to the display area 111. It should be understood that, the present disclosure should not be limited to the aforementioned configuration. In practically, the gate driving circuit can be disposed at a top side, a bottom side or both the top side and the bottom side relatively to the display area.

Summary, the present disclosure provides a display device with configuration of connecting the auxiliary gate/data lines between the driving circuit and the gate/data lines parallel to the driving circuit and disposing one of the auxiliary gate/data lines which is connected to the gate/data lines farthest away from the driving circuit at more inner side relatively to the display area, so as to narrow down border and decrease the RC load, at the same time.

Although the present disclosure has been described in considerable detail with reference to certain embodiments thereof, other embodiments are possible. Therefore, the spirit and scope of the appended claims should not be limited to the description of the embodiments contained herein. It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A display device comprising:

a substrate, comprising a display area;

a plurality of gate lines disposed in the display area, wherein the gate lines are substantially parallel with a first edge of the display area, and the gate lines comprise a first gate line farthest from the first edge;

a driving circuit disposed adjacent to the first edge; and a plurality of auxiliary gate lines disposed in the display area, wherein the auxiliary gate lines are connected to the gate lines and substantially perpendicular relative to the data lines, and are in parallel with a second edge and a third edge of the display area, wherein the second edge and the third edge are opposite edges of the display area, wherein the auxiliary gate lines comprise:

a first auxiliary gate line configured to connect the first gate line to the driving circuit;

a fourth auxiliary gate line configured to connect the first gate line to the driving circuit;

one of at least two auxiliary gate lines disposed between the first auxiliary gate line and the second edge; and another of the at least two auxiliary gate lines disposed between the fourth auxiliary gate line and the third edge.

2. The display device of claim 1, wherein the auxiliary gate lines comprise a first auxiliary gate line group, and the first auxiliary gate line group comprises:

the first auxiliary gate line;

a plurality of second auxiliary gate lines disposed at one side relative to the first auxiliary gate line; and a plurality of third auxiliary gate lines disposed at another side relative to the first auxiliary gate line.

3. The display device of claim 2, wherein the auxiliary gate lines comprise a second auxiliary gate line group, and the first auxiliary gate line group comprises:

a fourth auxiliary gate line;

a plurality of fifth auxiliary gate lines disposed at one side relative to the fourth auxiliary gate line; and a plurality of sixth auxiliary gate lines disposed at another side relative to the fourth auxiliary gate line.

4. The display device of claim 3, wherein the first auxiliary gate line group and the second auxiliary gate line group are arranged in mirror symmetry.

5. The display device of claim 3, wherein the first auxiliary gate line group and the second auxiliary gate line group are arranged in translational symmetry.

6. The display device of claim 2, wherein a distance between the first auxiliary gate line and the second edge is equal to a length of the first edge divided by a sum of double amounts of the first auxiliary gate line, the second auxiliary gate lines, and the third auxiliary gate lines.

7. A display device comprising:

a substrate, comprising a display area, wherein the display area comprises a first area and a second area, the first area is adjacent to a first side edge of the display area, the second area is adjacent to a second side edge of the display area, and the first side edge and the second side edge are located at opposite sides relative to the display area;

a plurality of data lines, disposed in the first area and the second area, wherein the data lines comprise a first data line farthest from the first side edge in the first area;

a first driving circuit, disposed adjacent to the first side edge of the display area; and a plurality of auxiliary data lines, disposed in the first area and the second area, wherein the auxiliary data lines are connected to the data lines and substantially perpendicular relative to the data lines, and are substantially parallel with a top edge of the display area, and the auxiliary data lines in the first area comprises:

a first auxiliary data line, configured to connect the first data line to the first driving circuit; and at least one auxiliary data line, disposed between the top edge and the first auxiliary data line.

8. The display device of claim 7, wherein the first area and the second area are arranged in mirror symmetry.

9. The display device of claim 7, wherein the auxiliary data lines in the first area further comprises:

a plurality of second auxiliary data lines, disposed at one side relative to the first auxiliary data line; and a plurality of third auxiliary data lines, disposed at another side relative to the first auxiliary data line.

10. The display device of claim 7, wherein a first distance between the first auxiliary data line and the top edge is equal to a second distance between the first auxiliary data line and a bottom edge, and the top edge and the bottom edge are located on opposite sides of the display area.

* * * * *